US007001184B2

(12) United States Patent
Abouchar

(10) Patent No.: US 7,001,184 B2
(45) Date of Patent: Feb. 21, 2006

(54) SLIP RING WITH CONNECTOR PINS

(75) Inventor: John W. Abouchar, Fullerton, CA (US)

(73) Assignee: Unit Industries, Fullerton, CA (US)

( * ) Notice: Subject to any disclaimer, the term of this patent is extended or adjusted under 35 U.S.C. 154(b) by 0 days.

(21) Appl. No.: 10/428,707

(22) Filed: May 2, 2003

(65) Prior Publication Data

US 2004/0121622 A1 Jun. 24, 2004

Related U.S. Application Data

(60) Provisional application No. 60/435,832, filed on Dec. 20, 2002.

(51) Int. Cl.
*H01R 39/00* (2006.01)

(52) U.S. Cl. ..... 439/26; 439/13

(58) Field of Classification Search ..... 439/13, 439/23–26, 28, 29, 3

See application file for complete search history.

(56) References Cited

U.S. PATENT DOCUMENTS

| | | | | |
|---|---|---|---|---|
| 3,785,049 | A | 1/1974 | Kanamaru et al. | |
| 3,984,716 | A | 10/1976 | Stark | 310/232 |
| 4,043,621 | A | 8/1977 | Heinz | 384/510 |
| 4,420,198 | A | 12/1983 | Zerlik | |
| 4,422,699 | A | 12/1983 | Sakurai et al. | |
| 4,544,215 | A * | 10/1985 | Fritsch | 439/13 |
| 4,557,536 | A | 12/1985 | Geurts | |
| 4,684,179 | A | 8/1987 | Freeman | |
| 4,786,136 | A | 11/1988 | Cannon | 350/96.21 |
| RE32,805 | E * | 12/1988 | Engelmore et al. | 439/26 |
| 4,889,494 | A | 12/1989 | Kunz | 439/13 |
| 5,145,379 | A | 9/1992 | Benktander et al. | |
| 5,923,114 | A | 7/1999 | Senni | 310/232 |
| 6,049,967 | A | 4/2000 | Feuer, Jr. et al. | |
| 6,068,490 | A | 5/2000 | Salzberg | 439/25 |
| 6,071,125 | A * | 6/2000 | Shiozawa | 439/26 |
| 6,281,610 | B1 | 8/2001 | Klimann et al. | 310/143 |
| 6,561,813 | B1 * | 5/2003 | Rutten et al. | 439/26 |

* cited by examiner

*Primary Examiner*—P. Austin Bradley
*Assistant Examiner*—X. Chung-Trans
(74) *Attorney, Agent, or Firm*—Knobbe, Martens, Olson & Bear LLP

(57) ABSTRACT

A slip ring assembly for allowing electrical or electronic signal transfer between a stationary device and a rotating device includes a ring assembly and a brush assembly. The ring assembly comprises a plurality of assembled rings and spacers of selected widths positioned on a longitudinal tube having a slot and a hollow center. The tube may be provided with one or more bearings to allow the tube to be smoothly rotatable in a housing. A plurality of brushes unitarily formed with a plurality of connector pins are held by a brush holder which is removably received in the housing. The connector pins are configured to receive a standard male or female connector. The housing is typically incorporated into a body of a stationary device, and the tube may be attached to or incorporated into a rotating component of an electronic or electrical device.

32 Claims, 6 Drawing Sheets

SLIP RING WITH CONNECTOR PINS

CROSS-REFERENCE TO PROVISIONAL APPLICATION

This application claims the benefit of U.S. Provisional Patent Application Ser. No. 60/435,832, filed on Dec. 20, 2002, the entire contents of which is incorporated herein by reference.

BACKGROUND

1. Field of the Invention

This invention relates to rotating electric connections, and specifically to a slip ring assembly with connector pins.

2. Description of the Related Art

Many electrical and electronic devices have rotating parts which must maintain electrical contact throughout rotation in order to transfer signals and/or power. Such devices typically require the use of slip rings which generally include one or more cylindrical contacts per circuit and one or more brushes configured to electrically contact the rings. As the rings rotate, the brushes ride and wear against the rings and eventually the brushes may have to be replaced. Additionally, if the rings are thinly plated, they may eventually become worn to a degree that they must also be replaced.

Typically the brushes are connected to a desired device by lead wires extending from the brushes to one or more terminals which may be configured to receive a male or female connector. This requires a soldered connection between the brushes and the lead wires, as well as a soldered connection between the lead wires and the terminals. Due to the added process step created by additional soldered connections, it is desirable to minimize the number of soldered connections in a manufactured device. It is also desirable to provide a slip ring assembly in which brushes are more easily replaceable.

Additionally, the rings of previous slip ring devices have been somewhat difficult to manufacture, reconfigure and replace due to the methods of assembly traditionally used in building slip ring assemblies. It is therefore also desirable to provide a simpler, more cost effective method of assembling and disassembling a slip ring.

SUMMARY

Thus in one embodiment, a slip ring comprises a housing configured to removably receive a brush assembly and a ring assembly. The brush assembly generally includes a brush holder configured to be removably mountable in the housing. The brush holder also includes a plurality of brushes and a plurality of connector pins extending therefrom. Each of the plurality of brushes is in electrical communication with a corresponding connector pin. In some embodiments, each brush and corresponding connector pin pair is integrally formed from a unitary piece of material. The ring assembly generally includes a longitudinal central body, which is rotatably mounted in the housing, and a plurality of electrically conductive rings on the central body. The ring assembly often includes a plurality of electrically conductive rings on the central body and at least one spacer disposed between adjacent rings. The spacers may be provided for insulation, circuit separation and/or for adjustment of the ring spacing. The slip ring of the present embodiment is preferably configured such that at least one ring is maintained in physical contact with at least one brush as the central body rotates relative to the housing.

According to another embodiment, a slip ring comprises first and second housing segments, each having a channel with a longitudinal axis. The assembly of this embodiment further comprises a brush holder removably held by a portion of the first housing segment. A plurality of brushes extend from a first side of the brush holder such that they extend into a portion of the channel of the first housing segment. The brush holder also includes a plurality of connector pins extending from a second side. A ring assembly including a central body, a plurality of conductive rings, and a plurality of spacers, is also removably received in the channels of the first and second housing portions.

In still another embodiment, a method of assembling a slip ring is provided. The method includes the steps of providing a longitudinal tube with a substantially hollow center, a first end, a second end, and a longitudinal slot, and providing at least one conductive ring. The method further includes providing at least one rotational bearing and positioning the bearing on the first end of the tube. A lead wire is attached to an inside surface of the ring such that the lead wire and the ring are maintained in electrical communication. The ring is then positioned on the tube between the bearing and the second end such that the lead wire extends through the slot and out the second end of the tube.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the present invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Having thus summarized the general nature of the invention, certain preferred embodiments and modifications thereof will become apparent to those skilled in the art from the detailed description herein having reference to the figures that follow, of which.

DETAILED DESCRIPTION OF THE PREFERRED EMBODIMENT

Figure 1:
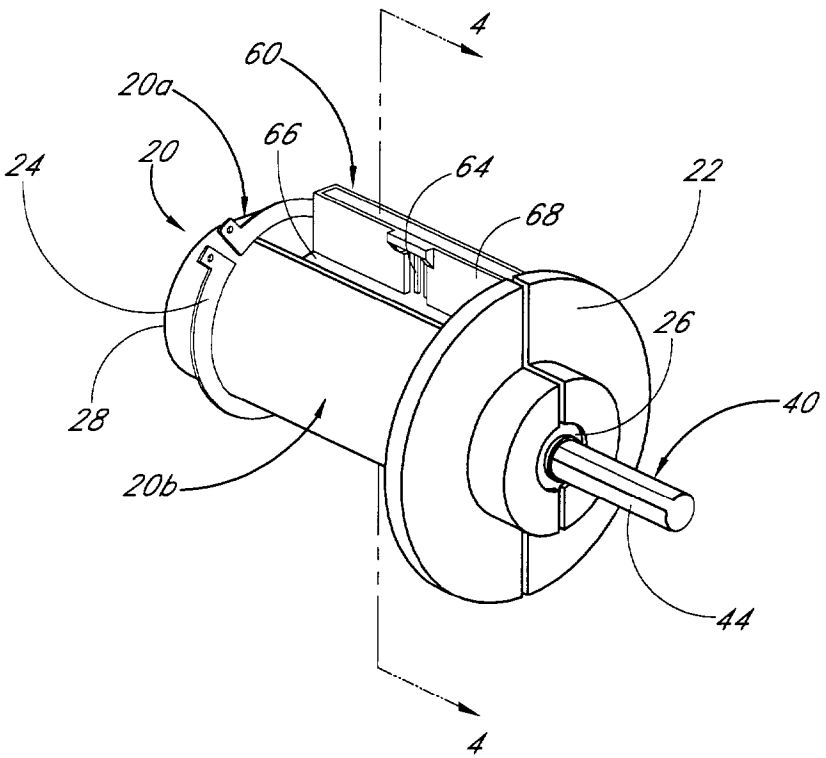
FIG. 1 is a perspective view of a slip ring assembly.

FIGS. 1–5 illustrate a slip ring assembly 10 having desirable features and advantages and usable in an electronic or electrical device (not shown) having a rotating component and a stationary component which are desirably maintained in electrical communication. The slip ring 10 generally includes a housing 20. The housing 20 typically includes a longitudinal channel for receiving a ring assembly 40. The ring assembly 40 typically includes a plurality of conductive rings 42 and insulating spacers 48 disposed on a central body 44 which is rotatable relative to the housing. Each ring 42 generally includes an electrical lead wire attached to an inner surface thereof which extends out an end of the central body 44. A brush assembly 60 having a plurality of brushes 62 and connector pins 64 extending from a brush holder 66 is removably received in the housing 20. See FIG. 5.

Typically, the housing 20 will be formed such that it may be mounted to a substantially stationary component of an electronic or electrical system having a rotatable component. For example, the housing 20 may be provided with one or more flanges 22 for attaching the housing to a stationary component. Alternatively, the housing 20 may be formed integrally with the stationary component of the device (not shown). The ring assembly 40 typically includes features to allow attachment of the central body 44 to a rotating component of the electronic device. Those skilled in the art will recognize that a slip ring 10 having the features and advantages described herein will be useful in any number of electronic devices with a rotating component and a stationary component.

Figure 2:
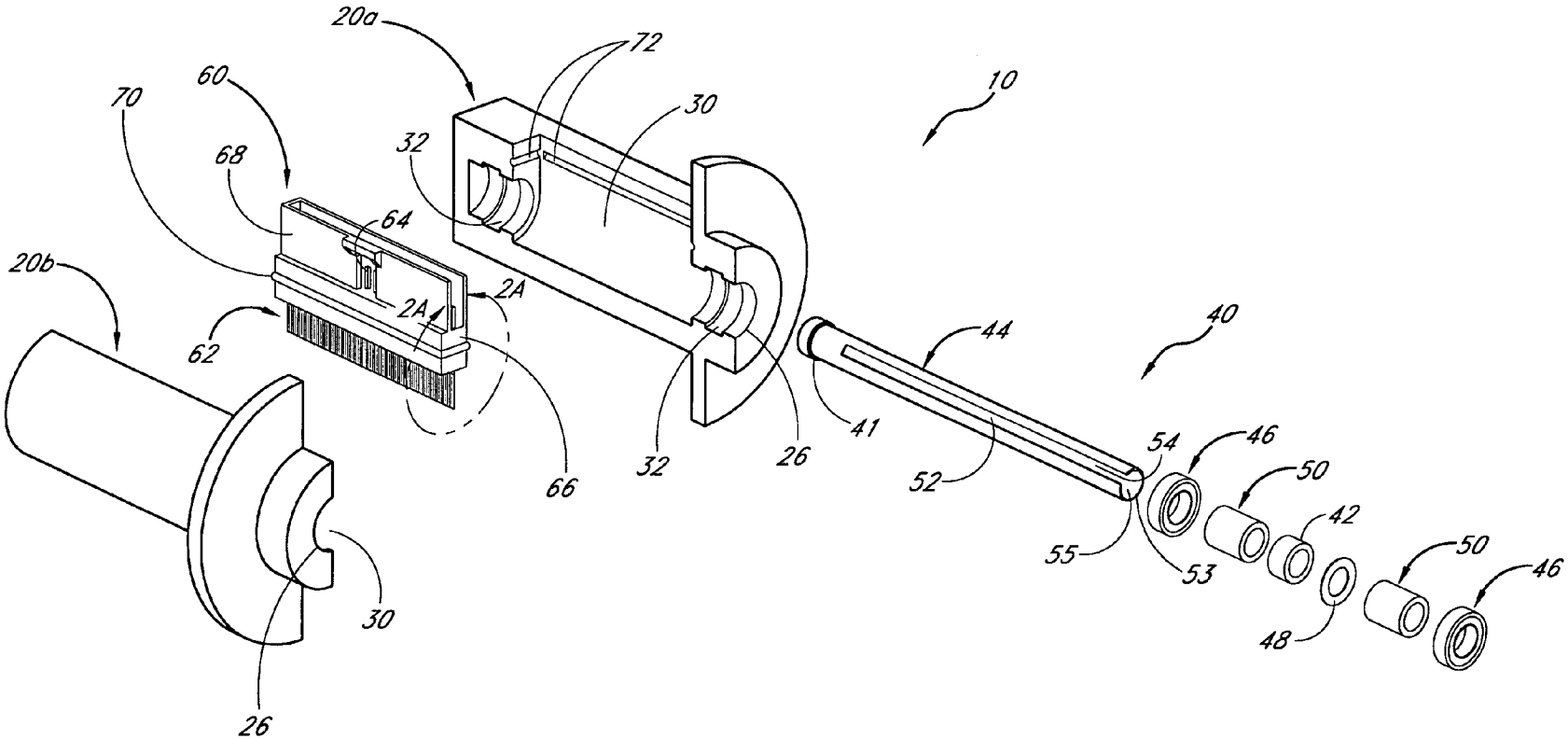
FIG. 2 is an exploded view of the slip ring assembly of FIG. 1.

In one embodiment, illustrated in FIGS. 1 and 2, the housing 20 comprises a wall defining a chamber therein for rotatably receiving a ring assembly 40. The illustrated housing is divided into first 20*a* and second 20*b* halves or sections. The housing sections 20*a*, 20*b* are held in an operative relationship to one another by a releasable retention structure such as a lock ring 24 or other suitable device. As assembled, the housing 20 generally includes an open end 26 and a closed end 28. The ring assembly 40 will extend from the open end 26 of the housing 20 such that the central body 44 and wires extending therefrom may be mechanically and electrically connected to a rotating component of an electronic or electrical device. The first and second housing sections 20*a*, 20*b* may be substantially similar in shape, with the exception that the first housing portion 20*a* typically includes features for removably receiving a brush assembly 60.

The housing sections 20*a* and 20*b* typically include a longitudinal chamber or channel 30 in which the ring assembly 40 may rotate. The housing sections 20*a*, 20*b* may also include recesses 32 for receiving and axially immobilizing one or more bearings 46. In an alternative embodiment, the housing 20 may include a hinged connection between the first 20*a* and second 20*b* portions, or the housing 20 may be provided as a single piece. Alternatively still, both the first 20*a* and second 20*b* housing portions may be configured to receive a portion of the brush assembly 60.

The brush assembly 60 typically comprises a plurality of flexible (typically metallic) brushes 62, a brush holder 66, and a plurality of connector pins 64. The brush assembly 60 may also include a connector housing 68 for receiving a complementary electrical connector. The connector housing 68 is often configured to receive a female connector, however, in some embodiments it may be desirable to configure the housing 68 such that it may receive a male connector. The brush holder 66 preferably includes features to allow the brush assembly 60 to be removably received in the housing, such as within first housing portion 20*a* so that the brush assembly 60 may be replaced as needed.

In the embodiment shown, the brush assembly 60 is substantially linear such that all of the connector pins lie substantially in the same plane. Those skilled in the art will recognize, of course, that the brush assembly 60 may be adapted such that the connector pins 64 are arranged in any orientation to accept a complementary connector having any desired shape.

Figure 2A:
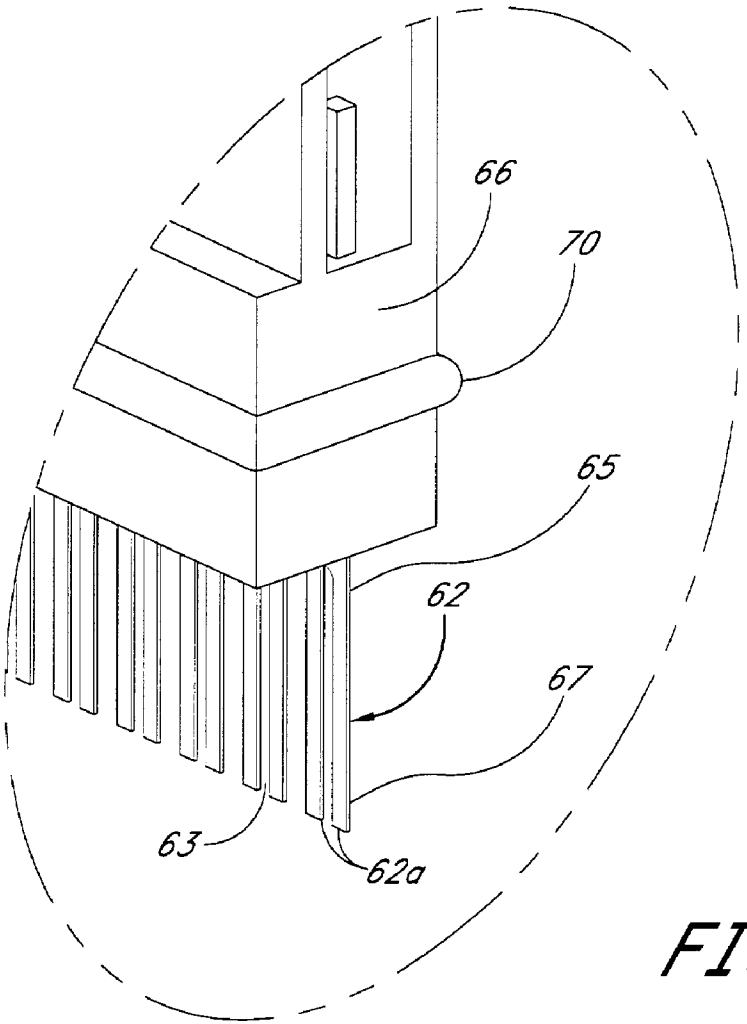
FIG. 2A is a detail view of a ring of the slip ring assembly of FIG. 2.

With continued reference to FIGS. 2 and 2A, each brush 62 may comprise a pair of flexible fingers 62*a* separated by a slot 63. Advantageously, the slot 63 allows the fingers 62*a* to be more flexible than a single finger of the same width. Additionally, the provision of a slot allows for increased versatility and adjustability. For example, one finger 62*a* may be cut, removed, bent or otherwise adjusted in order to slightly vary the spacing of a slip ring circuit. Alternatively of course, the brushes 62 may be provided as a single finger of any desired width without a slot. The brushes 62 are typically unitarily formed with the connector pins 64, however, the brushes 62 and pins 64 may be separate pieces of material joined in electrical communication by wires or other conductive members.

The brushes 62 may be substantially planar as shown, or they may comprise one or more curves to provide a larger or smaller contact area between the brushes 62 and the conductive rings 42. In one embodiment the brushes 62 and connector pins 64 are made of brass or beryllium-copper (BeCu) and are plated or coated with gold. Alternatively, the brushes and pins may be made from any other conductive material and coated or plated with any other conductive corrosion-resistant material recognized as suitable. In order to provide for extended wear resistance, a conductive block of a larger cross-sectional area may be integrally formed with or attached to each brush in a position such that the block will contact the ring(s). Such conductive blocks may be provided in any desired size in order to provide desired wear characteristics. The brushes 62 may be resiliently biased toward the ring assembly 40 with sufficient force that the brushes 62 remain in contact with the rings 42 during rotation of the ring assembly 40 and use of the device. The connector pins 64 typically have somewhat larger cross-sectional dimensions such that they have sufficient rigidity that they are less likely to be bent during use and handling.

The array of brushes 62 or brushes 62 and pins 64 may be manufactured in accordance with any of a variety of techniques. In one exemplary technique, the brushes 62 are cut from a sheet of conductive material such as by laser cutting, EDM, chemical etch, machining, stamping or other techniques known in the art. For example, in one embodiment, a piece of Be Cu with a thickness of about 0.020" may be etched to the appropriate shape, and may be reduced in thickness to about 0.008" at a portion forming a brush 62. In further embodiments, brushes and connector pins may be formed from a conductive base material of any dimensions appropriate for the particular application in which the slip ring assembly is to be used.

Referring to FIG. 2A, each brush 62 may be considered to have a base or attachment end 65, and a free end 67. During the manufacturing process, the free ends 67 of each adjacent brush 62 may be connected by a transverse connector such as a transversely extending strip of the base sheet stock from which the brushes 62 have been formed. This transverse connector maintains the brushes 62 in their proper orientation, during the manufacturing step. A plurality of brushes 62 with or without integral connection pins 64 may then be positioned in a mold or otherwise processed to attach the brushes 62 to the insert 66. Following formation of the assembled brush assembly 60, the transverse connector may be severed from the brushes 62 such that each brush 62 now terminates in a free end 67. The transverse connector may be severed immediately following formation of the brush assembly 60. Alternatively, the transverse connector may remain intact such as if the brush assembly 60 needs to be shipped to an alternate assembly location, stored, plated, or otherwise may encounter handling which could damage the brushes 62 in the absence of the transverse connector.

The brushes 62 and pins 64 are held by an insert or brush holder 66. The insert 66 is typically made by molding a plastic around the brushes 62 and pins 64 in order to securely hold the brushes 62 and pins 64 in an operative relationship as described. Alternatively, the brush holder insert 66 may be independently formed such that it may be later assembled to surround and hold the brushes 62 and pins 64. The insert 66 may be injection molded from a thermoplastic, compression molded from a thermoset plastic, or molded or cast by any process from any appropriate thermoset or thermoplastic material. The insert 66 may be provided with first and second complementary alignment surface structures such as first V-shaped ridges 70 configured to be inserted in complementary second V-shaped grooves 72 in the first body portion 20*a*. In further alternative embodiments, the ridges 70 can be substantially U-shaped as shown in FIG. 2. The ridges 70 and corresponding grooves 72 preferably provide a substantially tight seal between the insert 66 and the housing 20 and insure the proper alignment of the brushes 62 and pins 64 in the housing 20 relative to the ring assembly 40.

The ring assembly 40 generally includes a central body 44 comprising a longitudinal, typically hollow tube with a slot 52 along at least a portion of its length. The slot preferably opens into the open end 55. In an alternative embodiment, the tube of the central body 44 comprises a longitudinal solid-centered rod with at least one channel along its length, the channel being sized to receive a plurality of lead wires. The central body 44 may also be made of any suitable material. The tube of the central body 44 is preferably made from or coated with a substantially electrically non-conductive material. For example, the central body may be a molded plastic. The tube of the central body 44 may be mechanically joined to a rotating component of an electronic or electrical device by any suitable mechanism or method available.

Figure 5:
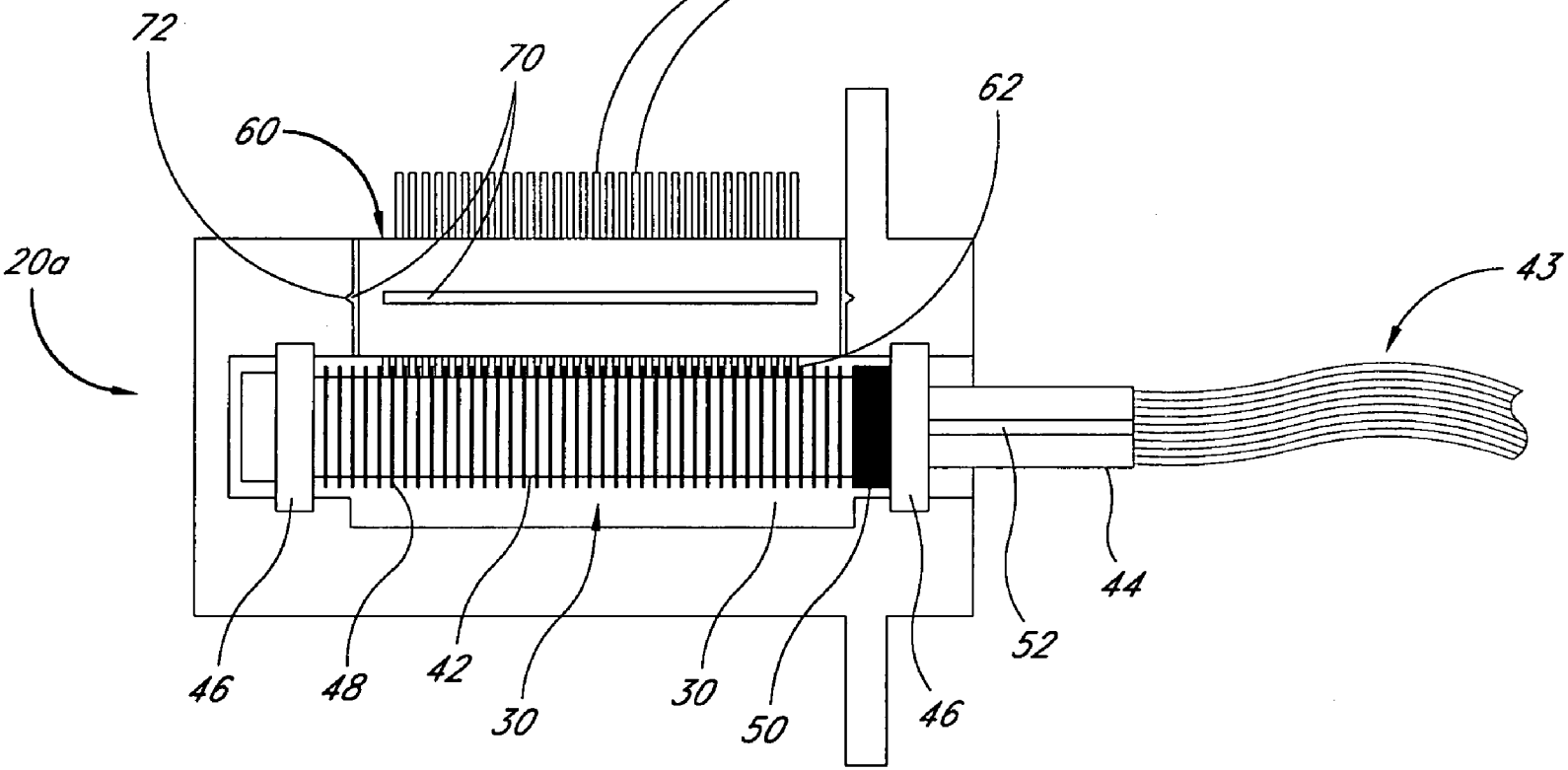
FIG. 5 is a plan view of a first body portion with a brush assembly and ring assembly therein.

With reference now to FIGS. 2 and 5, a plurality of rings 42 and spacers 48 are configured to be disposed along the outside of the central body 44 such that the rings 42 are aligned with appropriate brushes 62 in a desired number and combination. Each ring 42 typically has a lead wire 43 soldered, welded or otherwise mechanically and electrically connected thereto, such as to the inner surface 45 of the ring 42 (seen best in FIG. 3B). The rings 42 may then be assembled on the central body 44 such that the lead wire 43 extends through the slot 52, through the hollow center 54 and out the open end 55 of the central body 44. The lead wires 43 may then be connected to a standard connector carried by the central body 44 or connected remotely. The wires 43 may alternatively be connected directly to a circuit board or other device as desired.

The conductive rings 42 may be made of, coated, or plated with any suitable material such as BeCu, brass, a precious metal alloy, or other conductive material. For example, rings may be formed by drawing a brass tube with a gold alloy overlay of about 0.005," thereby cladding the tube with the gold. Rings 42 of a desired axial length may then be cut from the tube. In some embodiments, it may be desirable to polish the outer surface of the rings in order to reduce electrical noise. The rings 42 are typically sized to fit concentrically on the central body 44 in a snug fit such that the rings 42 are prevented from rotating relative to the central body 44. Alternatively, the rings 42 may be prevented from rotating relative to the central body 44 by the lead wire 43 extending through the slot 52 or by any of a variety of spline and groove or other rotational locking interfit structures. Once the rings, lead wires, and spacers have been assembled on the central body, the interior 54 of the central body 44 may be filled or encapsulated by injection of a liquid sealant or epoxy in order to substantially secure the ring assembly components in a desired arrangement.

Non-conductive spacers 48 may be disposed between adjacent rings 42 in order to provide insulation and control the distance therebetween. Spacers 48 are typically dimensioned according to the desired incremental spacing between adjacent rings 42 and/or brushes 62. Spacers 48 may be made of any suitable insulating material such as nylon, or other plastic generally in the shape of a washer and optionally having an outer diameter that is larger than an outer diameter of the conductive rings as illustrated in FIG. 5. As will be clear to the skilled artisan in view of the present disclosure, the provision of spacers 48 (washers) with larger diameters than the conductive rings 42 creates a physical barrier between adjacent rings 42, thereby preventing each brush 62 from migrating and undesirably contacting an adjacent ring 42. In some configurations, it may be desirable to omit one or more spacers 48 and place adjacent conductive rings 42 in contact with one another. Additionally, spacing sleeves 50 may be provided to maintain a desired separation between a bearing 46 and the ring/spacer array. Spacing sleeves 50 generally have a longer axial dimension than the spacers 48 in order to provide additional spacing with a single piece. The bearings 46 may comprise any rotational bearing elements determined to be suitable, such as ball bearings.

Thus, the method of assembling the ring assembly 40 in accordance with the present invention may be scaled up or down as desired, and may provide infinite variety in terms of the number of electrical conductor rings, spacing between rings, and size of adjacent rings. For example, anywhere from a single conductor ring 42, 10 or more conductor rings 42, 20 or more conductor rings 42, 50 or more conductor rings 42, or higher numbers may be assembled onto the central body 44 in accordance with the present invention. Each adjacent pair of conductor rings 42 may be separated by an insulating washer such as the spacer 48. In customized applications, where certain electrical conductors are known to have elevated power handling requirements or other considerations, the axial length of one or more conductor rings 42 in a first set may be larger than the axial length of each of a second set of conductor rings 42 on the same central body 44. Specific customization designs will become apparent to those of skill in the art in view of the disclosure herein, taking into the consideration the needs of a particular slip ring assembly.

Figure 4:
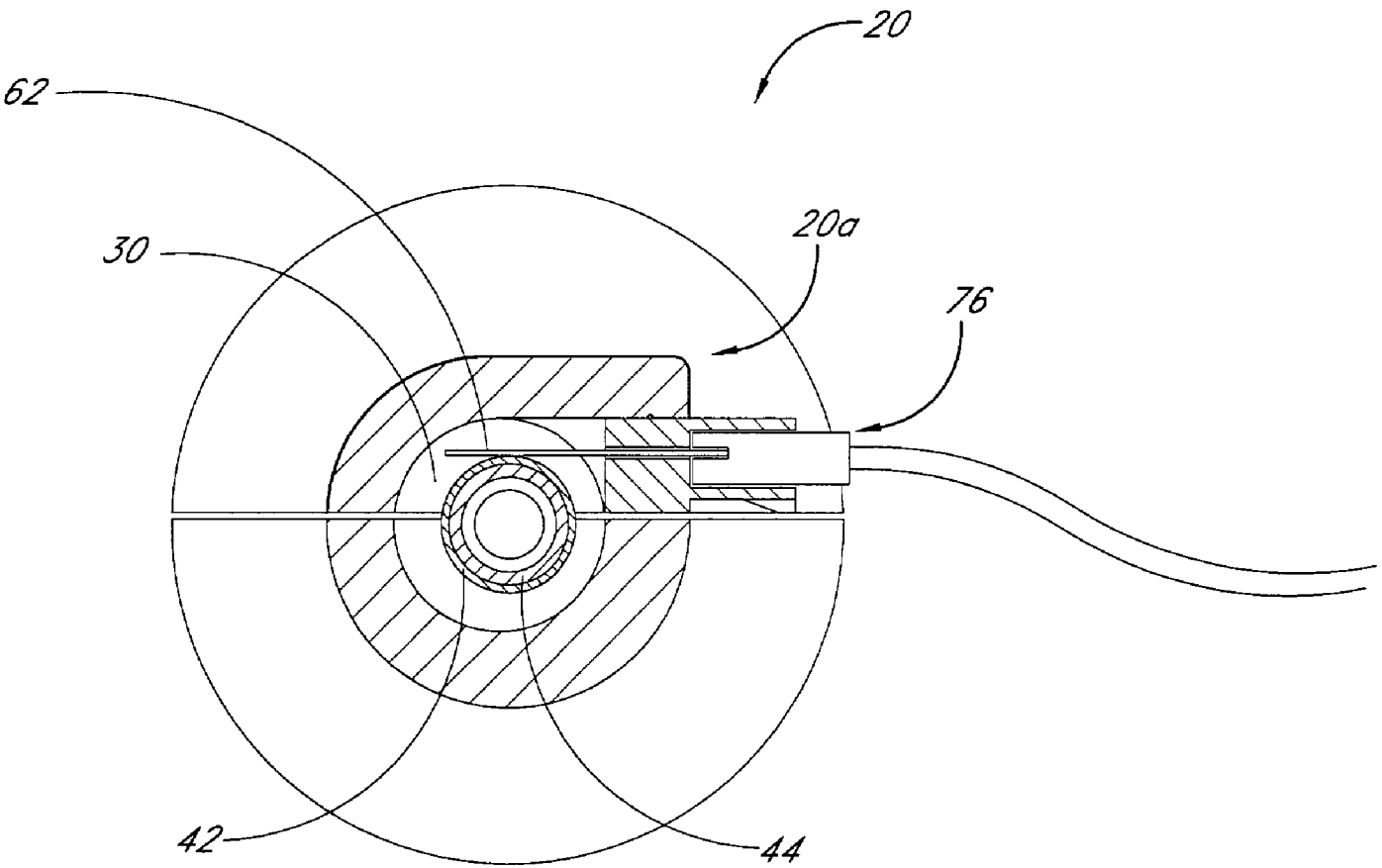
FIG. 4 is an axial cross section taken through line 4—4 of FIG. 1.

FIG. 4 shows an axial cross section of one embodiment of a possible arrangement of parts within a slip ring 10 having desired features and advantages. In the embodiment shown, the brushes 62 are molded into the insert such that they contact the rings 42 at a tangent. A connector 76 with a ribbon of wires may be connected to the pins 64 of the brush assembly 60. The connector and/or the brush holder may include features adapted to secure the connector to the housing to prevent the connector from becoming undesirably disengaged. Many connector configurations are known which may be useful with a slip ring as described herein. As will be clear to those skilled in the art in view of the present disclosure, the connector pins 64 and/or the housing 20 may be configured to receive any male or female connector as desired.

As seen in FIG. 2, the brush assembly 60 and the ring assembly 40 are removably mounted in the housing 20 such that the brushes 62 contact the individual conductive rings 42. The pins 64 of the removable brush assembly 60 allow the slip ring 10 to be easily joined to a female connector, thus providing a simple field-changeable package.

With reference to FIGS. 2 and 5, an exemplary method of assembling a slip ring will now be described. The method generally includes providing a central body 44 with a longitudinal slot 52 and a hollow center 54. A bearing 46 is then positioned on the central body 44 typically by sliding the bearing 46 along the tube of the central body 44 to a first end 41 of the tube of the central body 44. A spacer 48 or spacing sleeve 50 may then be positioned on the tube of the central body 44 adjacent the bearing 46. A first conductive ring 42 may then be positioned on the tube of the central body 44 between the bearing 46 and the second end 53 of the tube of the central body 44. A spacing sleeve 50 is typically dimensioned such that a spacing between the bearing 46 and a conductive ring 42 will allow the ring 42 to be aligned with a brush 62. If more than one conductive ring 42 is desired, one or more spacers 48 may be positioned between adjacent rings 42 thereby creating an array of rings 42 and spacers 48 on the central body 44. The spacers 48 are typically dimensioned to provide consistently appropriate spacing between adjacent rings 42 such that each ring 42 aligns with a unique one of the brushes 62. If desired, the ring array may be varied such as by omitting spacers, thereby providing adjacent rings in contact. Alternatively, a single brush 62 may be provided in contact with more than one ring 42, or more than one brush 62 may be positioned to be in contact with a single ring 42. The skilled artisan will appreciate that the components described herein may be arranged in an infinite number of configurations providing a substantial degree of versatility. Once the last desired ring 42 is positioned on the tube of the central body 44, a second bearing 46 may be positioned at an appropriately spaced location on the tube of the central body 44.

Figure 3B:
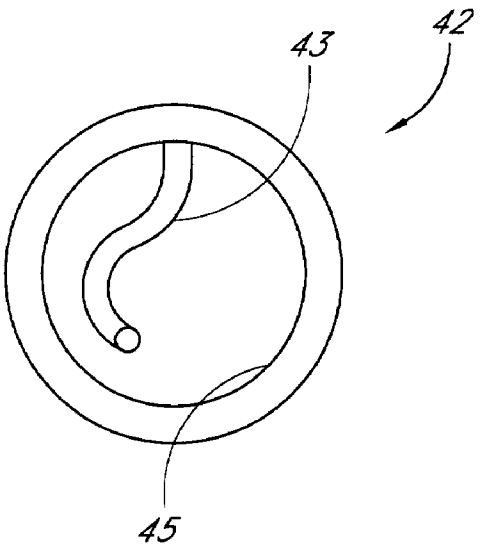
FIG. 3B is an end elevation view of the conductor ring of FIG. 3A.
Figure 3A:
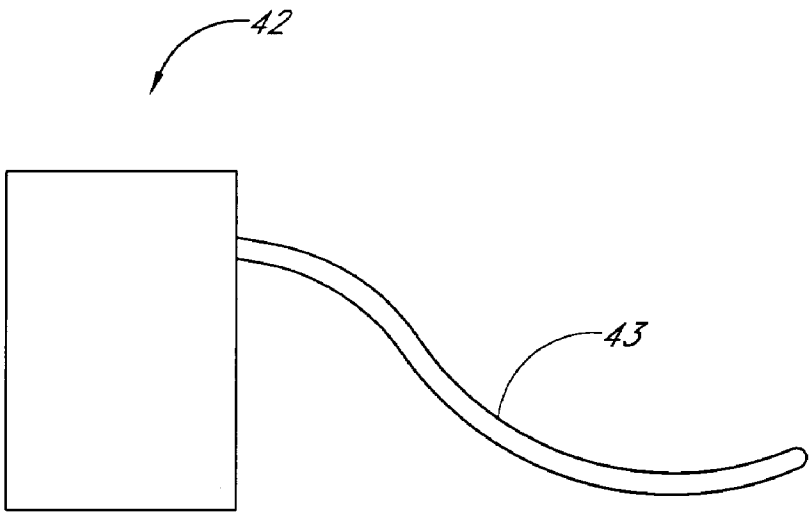
FIG. 3A is a side elevation view of a conductor ring.

With reference to FIGS. 3A to 3B, exterior insulated lead wires 43 are typically soldered or welded to an inner surface 45 of the rings 42. Thus, the rings 42 are preferably positioned on the central body 44 such that the lead wires 43 extend through the slot 52, through the hollow center 54, and extend out of the opening 55 at the second end of the tube of the central body 44. If desired the central body may be provided with two open ends through which lead wires may extend. A complete ring assembly 40 comprising the tube of the central body 44, rings 42, spacers 48, spacing sleeves 50, and bearings 46 may be inserted into a slip ring housing 20 such that each ring 42 aligns with a particular brush 62 of a brush assembly 60. According to one embodiment, the brush assembly 60 may be provided with a unique connector pin 64 corresponding to each unique brush 62 (best seen in FIG. 5). The connector pins 64 may be arranged such that a standard female connector 76 may be attached thereto in order to join the brushes 62, and thus the rings 42 and lead wires 56, in electrical communication with a device attached to the connector.

The slip ring assembly described herein provides a number of unique advantages. The ring assembly can be easily modified to provide a greater or lesser number of circuits or contacts per circuit. The nature of the assembly allows such modifications to be easily made in the field without the necessity of specialized tools. Additionally, the slip ring assembly described herein provides a plurality of connector pins which may be integrally formed with the brushes in order to provide a simple connection between the slip ring brushes and a lead wire ribbon. These connector pins allow for further field-adjustability of the slip ring assembly. The ease of field-adjustability also allows for rings and/or brush assemblies to be easily replaced in the field as these components become worn out through normal use.

Although certain embodiments and examples have been described herein, it will be understood by those skilled in the art that many aspects of the methods and devices shown and described in the present disclosure may be differently combined and/or modified to form still further embodiments. Additionally, it will be recognized that the methods described herein may be practiced using any device suitable for performing the recited steps. Such alternative embodiments and/or uses of the methods and devices described above and obvious modifications and equivalents thereof are intended to be within the scope of the present disclosure. Thus, it is intended that the scope of the present invention should not be limited by the particular embodiments described above, but should be determined only by a fair reading of the claims that follow.

What is claimed is:

1. A slip ring assembly comprising:

a housing configured to removably receive a brush assembly and a ring assembly;

a brush assembly comprising a brush holder formed as a separate unitary structure distinct from the housing and configured to be mounted in, removed from, and replaced in the housing, the brush assembly having a plurality of brushes and a plurality of connector pins extending from the holder in a cantilevered manner, each of the plurality of brushes comprising a thin flexible finger in electrical communication with a corresponding connector pin, wherein the connector pins are sized and configured to be joined to a standard connector;

a ring assembly comprising a longitudinal central body rotatably mounted in the housing, a plurality of electrically conductive rings on the central body; and at least one spacer disposed between at least one pair of adjacent rings;

wherein the slip ring assembly is configured such that at least one ring is maintained in physical contact with at least one brush as the central body rotates relative to the housing;

wherein each brush and corresponding connector pin are made of a unitary piece of material; and wherein the brushes have a thickness dimension which is substantially smaller than a corresponding thickness dimension of their respective connector pins.

2. The slip ring of claim 1, wherein the housing is made of a molded plastic.

3. The slip ring of claim 1, wherein the brush holder is a plastic molded around the brushes and connector pins.

4. The slip ring of claim 1, wherein the brush holder is a plastic assembled around the brushes and connector pins.

5. The slip ring of claim 1, wherein at least an outer surface of the brushes and connector pins comprise a conductive, corrosion-resistant material.

6. The slip ring of claim 1, wherein the spacer has an outer diameter that is larger than an outer diameter of the conductive rings.

7. The slip ring of claim 1, wherein a brush member comprises a thickness of about 0.008 inch and a corresponding connector pin comprises a thickness of about 0.020 inch.

8. The slip ring of claim 1, wherein the plurality of conductive rings are slidably disposed on the central body.

9. The slip ring of claim 8, wherein the housing comprises first and second halves.

10. The slip ring of claim 1, wherein each of the conductive rings has a lead wire attached to an inner surface thereof.

11. The slip ring of claim 10, wherein each lead wire is in electrical communication with a corresponding connector pin.

12. A system for replacing worn brushes in a slip ring assembly, the system comprising:

a slip ring comprising a first housing segment having a channel with a longitudinal axis; a second housing segment having a channel with a longitudinal axis; a brush holder removably held by a portion of the first housing segment; a plurality of brushes carried by a brush holder body and extending from a first side of the brush holder such that the brushes extend into a portion of the channel of the first housing segment; a plurality of connector pins carried by the brush holder body and extending from a second side of the brush holder, wherein the connector pins are more rigid than the brushes; a ring assembly removably received in the channels of the first and second housing portions, the ring assembly including a central body, a plurality of conductive rings, and a plurality of spacers; and at least one replacement brush holder, whereby the brush holder is configured to be removed from the first housing segment such that the replacement brush holder can be inserted therein.

13. The slip ring of claim 12, wherein the rings and spacers are slidably disposed on the central body.

14. The slip ring of claim 12, wherein at least an outer surface of the brushes comprises a corrosion-resistant material.

15. The slip ring of claim 12, further comprising at least one roller bearing between the central body and at least one of the first housing segment and the second housing segment.

16. The slip ring of claim 12, wherein the brush holder comprises V-shaped or U-shaped locking structures.

17. The slip ring of claim 12, further comprising a lead wire electrically bonded to an inner surface of each of the plurality of conductive rings.

18. The slip ring of claim 17, wherein each lead wire is in electrical communication with a selected one of the connector pins.

19. The slip ring of claim 12, wherein each of the brushes is unitarily formed with a corresponding connector pin.

20. The slip ring of claim 19, wherein the brushes have a thickness dimension which is substantially smaller than a thickness dimension of each corresponding connector pin.

21. The slip ring of claim 19, wherein the brush is split so as to form a pair of flexible fingers separated by a slot.

22. A slip ring comprising:

a housing comprising first and second halves, each half having a longitudinal channel, said first half being configured to receive an insert;

a longitudinal, hollow tube with a longitudinal slot, the tube being insertable into the channels of the first and second housing halves;

at least one roller bearing configured to be received on the tube;

at least one electrically conductive ring configured to be disposed on the tube;

a pair of electrically non-conductive spacers configured to be disposed on the tube on either side of the at least one electrically conductive ring, wherein the spacers have an outer diameter that is larger than an outer diameter of the at least one electrically conductive ring; and a brush holder having at least one brush extending into a portion of the channel of the first half, and having at least one connector pin extending from the brush holder and configured to be in electrical communication with the at least one brush;

wherein the slip ring is configured such that the at least one brush is maintained in electrical contact with the at least one electrically conductive ring throughout rotation of the tube relative to the housing, and whereby the spacers maintain an axial position of the brush relative to the at least one electrically conductive ring; and wherein the at least one brush is integrally formed with the at least one connector pin, and wherein the at least one connector pin has a thickness dimension which is larger than a thickness of the brush.

23. The slip ring of claim 22, wherein the at least one connector pin lies in substantially the same plane as the at least one brush.

24. The slip ring of claim 22, wherein said brush holder is separate from the housing and is configured to be inserted into and removed from the housing for replacement of the bush holder.

25. The slip ring of claim 22, wherein the brush holder is made of a molded plastic material, and wherein the at least one brush and the at least one connector pin are molded into the brush holder.

26. The slip ring of claim 22, wherein the brush holder is configured to receive and attach to a connector.

27. A method of assembling a slip ring comprising:

providing a longitudinal tube with a substantially hollow center, a first end, a second end, and a longitudinal slot;

attaching lead wires to inner surfaces of a plurality of conductive rings;

positioning at least one rotational bearing onto the first end of the tube;

positioning a first ring on the tube between the bearing and the second end such that the lead wires extend through the slot, and out the second end of the tube;

placing a non-conductive spacer adjacent to the first ring, the spacer having an outer diameter that is larger than an outer diameter of the conductive rings, and placing a second ring adjacent to the spacer, thereby sandwiching the spacer between the first and second rings;

placing the tube in a slip ring assembly housing such that the at least one ring is in electrical communication with a brush, the housing comprising first and second halves, wherein one of the halves comprises a brush holder having a plurality of brushes and connector pins extending there from, the brush holder being removable from the housing;

positioning the plurality of conductive rings on the tube, wherein a first ring has an axial length that is greater than an axial length of a second ring; and removing the brush holder, discarding the brush holder, and inserting a new brush holder;

whereby the spacer prevents a brush which is in contact with the first ring from contacting the second ring.

28. The method of claim 27, further comprising positioning third and fourth conductive rings on the tube adjacent to and in direct contact with one another.

29. The method of claim 27, further comprising attaching a female connector to a connector pin which is integrally formed with the plurality of brushes.

30. The method of claim 27, wherein the spacer is a washer made of a non-conductive material.

31. A replacement brush holder for use in a slip ring having a housing configured to receive the brush holder, and a ring assembly comprising a plurality of conductive rings and a plurality of spacers supported in the housing, the brush holder comprising:

a molded insert comprising a prismatic body having a first side and a second side, wherein the first side and the second side do not lie in the same plane;

a plurality of brushes extending from the first side of the insert, each brush comprising a thin flexible finger extending from the insert in a cantilevered manner;

a plurality of connector pins extending from the second side of the brush holder, wherein the connector pins are more rigid than the brushes;

wherein the molded insert comprises features configured to correspond with features in the housing such that the brush holder can be frictionally retained in the housing such that the brushes extend into a portion of the housing and contact respective ones of the rings.

32. The replacement brush holder of claim 31, further comprising a connector housing surrounding the connector pins and configured to receive and retain a standard connector.

* * * * *

UNITED STATES PATENT AND TRADEMARK OFFICE

CERTIFICATE OF CORRECTION

PATENT NO. : 7,001,184 B2
APPLICATION NO. : 10/428707
DATED : February 21, 2006
INVENTOR(S) : John W. Aboucher It is certified that error appears in the above-identified patent and that said Letters Patent is hereby corrected as shown below:

At Column 7, line 33, after "on the" insert -- tube of the --.

Signed and Sealed this

Twenty-sixth Day of December, 2006

JON W. DUDAS
*Director of the United States Patent and Trademark Office*